United States Patent [19]

Murray et al.

[11] 4,254,328

[45] Mar. 3, 1981

[54] DISPENSING PRESET AMOUNTS OF A PRODUCT

[75] Inventors: Robert M. S. Murray; Brian E. Pitches, both of Edinburgh, Scotland

[73] Assignee: Ferranti Limited, Cheadle, England

[21] Appl. No.: 44,329

[22] Filed: May 31, 1979

[30] Foreign Application Priority Data

May 31, 1978 [GB] United Kingdom ..... 25485/78

[51] Int. Cl.[3] ..... G06M 3/02

[52] U.S. Cl. ..... 235/92 PE; 222/14; 235/92 FL; 235/92 CT

[58] Field of Search ..... 235/92 FL, 92 PE, 92 CT, 235/94 A; 222/14, 23; 364/465

[56] References Cited

U.S. PATENT DOCUMENTS

| | | | |
|---|---|---|---|
| 3,941,978 | 3/1976 | Huston et al. | 235/92 MP |
| 3,946,219 | 3/1976 | Lucas | 235/92 FL |
| 4,011,436 | 3/1977 | Schiller | 235/92 FL |
| 4,016,406 | 4/1977 | Abe et al. | 235/92 MP |
| 4,105,138 | 8/1978 | Lehmann et al. | 235/92 FL |

*Primary Examiner*—Joseph M. Thesz

*Attorney, Agent, or Firm*—Kerkam, Stowell, Kondracki & Clarke

[57] ABSTRACT

Apparatus for dispensing a preset monetary amount of product, such as fuel, sold by volume and for use with a dispenser which calculates and displays a continuously increasing cost of the delivery has a number of selector buttons which relate to units of cost and which when selected set an appropriate number into a counter. The counter is coupled to the display, and the count is decremented by one for each unit cost of product actually delivered. During delivery of the first unit a store calculates the difference between a unit cost and the cost of a small predetermined volume, which volume is required to be delivered slowly to end the delivery and avoid under- or over-delivery due to mechanical or fluid inertia of the dispenser. When the counter indicates the final unit preselected is being delivered, a comparator compares continuously the cost displayed for that unit and the stored difference and when they are equal the delivery rate is slowed for the final predetermined volume. The apparatus may be used with pre-stored values where delivery is by volume rather than cost.

7 Claims, 1 Drawing Figure

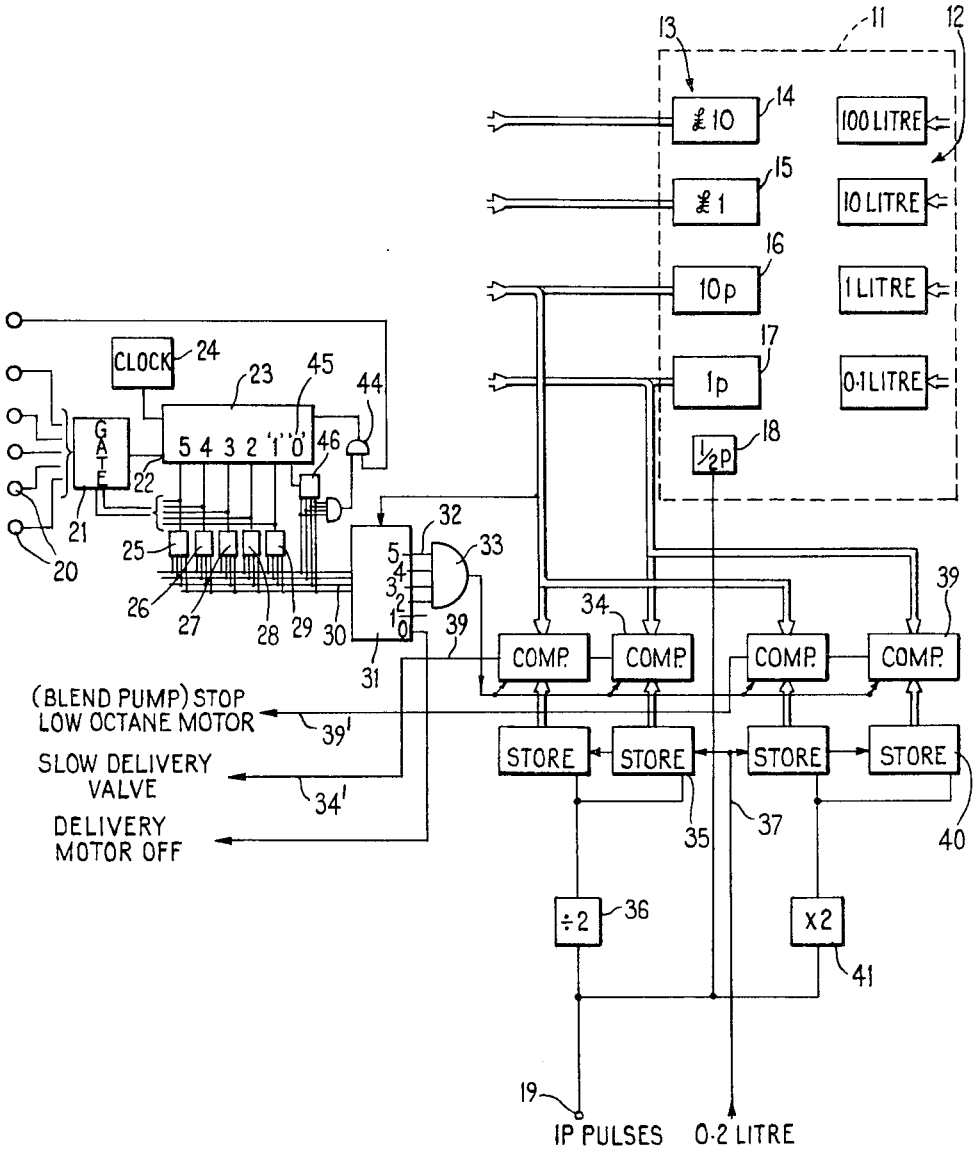
£10
£1
10p
1p
½p
100 LITRE
10 LITRE
1 LITRE
0·1 LITRE
CLOCK
GATE
5 4 3 2 1 0
COMP.
STORE
÷2
x2
(BLEND PUMP) STOP
LOW OCTANE MOTOR
SLOW DELIVERY
VALVE
DELIVERY
MOTOR OFF
IP PULSES
0·2 LITRE

DISPENSING PRESET AMOUNTS OF A PRODUCT

This invention relates to the dispensing of preset amounts of a product and in particular to control circuits therefor. A situation in which a product is dispensed by value or quantity exists with the sale of fuel, such as petrol, at a filling station. Such a facility is useful at attendant controlled stations in reducing the level of skill required of the attendant and may be used for customer operation in so-called self-service stations. It may be used also in conjunction with a money-acceptor in unattended stations so that only fuel paid for in advance is delivered.

The effects of mechanical and fluid inertia in the delivery system preclude the dispensing mechanism from merely being switched off on receipt of a "stop" signal from price indicating apparatus. Delivery has to be terminated in two stages, firstly by slowing up the delivery rate when there is a small volume, say 0.2 liters, to be delivered and finally stopping the pump when the quantity delivered corresponds to the preset value.

To obtain this result known pumps have been arranged so that the preset value of fuel to be dispensed is entered by a selector switch and displayed at the dispenser. When it is operated fuel is delivered at a normal rate and the displayed value counts down at a corresponding rate until it reaches zero. At some predetermined small value of count, the rate is slowed and delivery continued at this "slow" rate until a count of zero occurs and the delivery is terminated, that volume of petrol corresponding to the selected value having been delivered. The small value at which flow rate is changed is fixed and is determined from the unit price of the petrol and the volume remaining at which the change should occur.

Such an arrangement has several disadvantages. If the "slow-down" point is set too early in the delivery the delivery may take a long time to complete. If it is set too late the pump may over-deliver. This is particularly important in periods when fuel prices are changing frequently and adjustments have to be made frequently. Furthermore such an arrangement of counting down makes it difficult for the operator to monitor the cost incurred at any time during the delivery, should he decide to terminate the delivery early or should the vehicle be unable to accept the full delivery. Also because the instantaneous value has to be counted down from the preset level it is not possible to add a preset value facility to an existing dispenser which operates on a count-up basis.

The desire to dispense other products by their value may be satisfied in the same way.

A similar situation obtains with dispensing materials by quantity, that is, the weight or volume of bulk material or a number of articles in which one of a preset number of quantities may be desired but in which a continuously increasing indication of the quantity dispensed is desired. Again this is particularly suited to dispensing liquid fuel such as petrol.

It is an object of the present invention to provide a circuit arrangement for controlling the dispensing of a preset amount of a product, which arrangement mitigates the above disadvantages.

According to the present invention a circuit for controlling the dispensing of a preset amount of a product from apparatus having normal and slow rates of delivery and metering means operable to measure the quantity of product delivered and/or to calculate the monetary value thereof, comprises switching means operable to produce different signals for individual preset amounts of material to be dispensed in multiples of a unit amount, counting means responsive to the detection of a switch signal to store the number of units represented by the switch signal and operable to change the number stored by one for each unit amount dispensed, storage means for storing the difference between a predetermined amount of product and the unit amount and comparison means responsive to an indication from the counting means that the final unit of the preset amount is being dispensed to compare continuously the amount of product dispensed in the final unit with the stored difference to provide a signal, when the amounts are equal, to cause the dispensing to be changed from a normal to a slow delivery rate for delivery of said predetermined amount.

The circuit may be limited to controlling only the delivery of either a preset quantity or a preset value or of controlling both.

Where the preset amount is a monetary value the cost of a predetermined quantity dispensed is calculated and the difference between the value and a unit value is stored for comparison.

Embodiments of the invention will now be described by way of example with reference to the accompanying drawings in which the FIGURE is a schematic circuit arrangement of the controlling circuit applied to a petrol dispenser.

The petrol dispensing arrangement may be of the type described in co-pending application No. 35883/77 in which a plurality of freestanding dispensers are operated under the control of a central supervising location. Each dispenser responds to a train of pulses generated in proportion to the volume of petrol dispensed, pulses being multiplied in computer means in the dispenser by the price per volume of the petrol and the related cost displayed, with the volume delivered, both at the central location and the dispenser.

Referring to the FIGURE part of the circuitry of a dispenser is shown. The normal volume and cost calculating parts are not shown but operate as described in the above mentioned co-pending application to provide signals to a display portion 11. Display portion 11 comprises a volume display 12 and a price display 13. The price display comprises five digits 14, 15, 16, 17 and 18, representing respectively units of £10, £1, 10 pence, 1 penny, and ½ penny. Information is fed to the price display in binary form by the computer means such that as delivery proceeds each digit increases from 0 to 9 before the next higher digit increases by one, that is, for each £1 increase of 15, the digit 16 changes from 0 to 9 ten times and the digit 17 increases from 0 to 9 one hundred times and the digit 18 switches between 0 (or off) and ½ two hundred times. The computer produces pulses for every penny of petrol dispensed and these are fed to display digit 18 by way of terminal 19.

Of the control circuit the switching means comprises a set of six selector switches 20 five of which are connected by gating means 21 to triggering terminal 22 of a counter 23. The counter also has a clock 24 connected thereto to provide high frequency clock pulses. The counter has a plurality of parallel output terminals each energised at different stages of the count, say 0 to 5, and output terminals "1" to "5" are each connected to gating means 21 with the switch outputs such that for any switch operated the counter counts until the corresponding output is energised and the counting then stops. Each of the output terminals "0"–"5" is connected to an individual hexadecimal switch 25–29 the switches producing binary coded signals on lines 30 characteristic of which output terminal is energised and of the values shown by the selector switches.

Each of the five selector switches mentioned above relates to a value of petrol in units of £1, that is, pressing one switch selects £1, another switch £2, another switch £3 and so on. The sixth selector switches relates to an unlimited amount and its function will be described hereinafter.

The lines 30 connect the hexadeciaml switches to counting means 31 which is loaded with the number received from the counter 23 corresponding to the particular selector switch energised. The counting means 31 has a plurality of output terminals 32 representing "5" to "0" and a signal is produced at each one in turn in response to triggering pulses, effectively counting down from the number loaded to zero. Triggering pulses are derived by a connection to the most significant output of the 10 pence display so that a triggering pulse occurs each time that a further £1 is added to the value of fuel dispensed, that is, each time delivery of a unit amount occurs.

The four outputs "5"–"2" are all connected to a gate 33, which produces an output signal when said outputs are all zero and is equivalent to a "1" output, output "0" of counter 31 is connected to stop delivery completely.

The money signals to the display digits 17 and 16 and from the price calculating circuits of the pump (not shown) are also fed to a two decade comparator 34. The other inputs to the comparator are connected to a store 35 which store is arranged to receive and count penny pulses from 19 divided-by-two at 36. The penny pulses represent incremental increases in the cost of fuel dispensed. The store is arranged to count down from 100 (a unit value in pence) for a period determined by a signal received on line 37 and representing a predetermined volume of fuel dispensed. The comparator 34 is enabled to receive the signals of displays 16 and 17 when the counter 31 produces a "1" output and gate 33 signals on line 38. When equality exists between the signal fed to the display and the input from store 35 an output signal is provided to cause delivery to be reduced to a slow rate.

In operating of the circuit of the example the unit value of fuel dispensed is £1, and any multiple of this may be selected. For the purposes of example a customer is assumed to select £4 of petrol to be dispensed. The appropriate selector switch 30 is actuated and counter 23 gives an output on output "4" to hexadecimal switch 25 which in turn loads a "4" into the counting means 31.

When delivery commences a signal is generated to start display of the instantaneous value of the fuel delivered and continues until, or is followed by, a further signal when 0.2 liters have been delivered. This signal is used to gate store 35 so that the cost of the first 0.1 liters (in pence) is subtracted from the cost of one unit, 100 pence.

As each £1 unit of fuel is dispensed and the display increases by £1 a triggering signal is applied to counting means 31 which decrements by one. When there is £ 1 remaining gate 33 provides an output and the comparator 34 is enabled to accept the pence signals applied to 16, 17 as well as the stored signals. When equality occurs, that is, there is still 0.1 liters to be delivered, the comparator gives an output signal on line 34' to reduce the flow to a slow rate; when the £1 is completed the counting means 32 gives an output at "0" and the dispenser pump stops, flow ceasing when the value selected has been dispensed.

It will be appreciated that as this facility used an existing measuring, calculating and display layout value enabling the user to monitor the instantaneous increasing value of fuel dispensed it may be added to an existing dispenser arrangement with very little modification to the former other than the provision of a delivery valve switchable between normal and, slow delivery rates.

Where the dispenser is of the type which delivers a blend of petrol as selected by the customer from stock high- and low-octane fuelds, it is necessary to begin restricting the delivery rate at an earlier stage. To achieve this a further comparator 39 is provided in parallel with comparator 34 to receive also the price signals to display digits 16, 17 when enabled by the output of gate 33. The other inputs to the comparator 39 are from a further store 40, which store is arranged to receive and count penny pulses from input 19 by way of a multiply-by-two circuit 41. Line 37 is connected to the store to cause operation for the first 0.2 liters of fuel dispensed. The multiplier circuit responds to both leading and trailing edges of the penny pulses to produce two pulses per penny of fuel delivered from the first 0.2 liters. In operation when the last £1 of credit is entered both comparators 34 and 39 are enabled and count the penny units as supplied to the display. When equality is achieved in comparator 39, that is, 0.4 liter remains to be delivered, an output signal is supplied to the motor (not shown) controlling delivery of the low octane fuel to shut it off. The blending valve (not shown) operates automatically to try to maintain the correct blend and so begins to slow delivery of the high octane fuel to a low level. When equality is achieved in comparator 34 the output signal on line 39' restricts the flow rate still further and delivery of the final 0.1 liter of high octane petrol occurs until the counter 31 switches to its "0" output.

In addition to the features of the basic arrangement described above other features may be employed.

The sixth input switch 20 referred to earlier, is connected by way of gate 44 to a "clear" input of the register 23 so as to put it in a state to give an "0" output at a "0" terminal 45. The "0" terminal is connected to a hexadecimal switch 46 connected to the lines 30 in the same way as switches 25–29 and the outputs are also gated to input of gate 44. Operation of the input switch results in the register 23 assuming a "0" state and not loading counter 31. In this condition the shutting down procedure is not followed and fuel is dispensed until a trigger on the dispenser nozzle is released to block flow.

It will be appreciated that the above circuit, for which the preset value is entered by selection of the appropriate button 20, may be modified to operate in conjunction with a prepayment apparatus such as a bank-note validator. In such a case interlocks are provided to prevent operation unless at least £1 value of petrol is is selected.

Furthermore, although the above description has been directed at the dispensing of petrol, it may of course be employed for controlling the delivery of value of any other liquid or solid product.

The apparatus described above may be modified to dispense a predetermined quantity of liquid. The unit of volume is that by which the product is normally sold, for petrol the gallon, and the circuit arrangement (not shown) is similar to the described above but with the input to stores 35 and 40 absent. The store 35 is preprogrammed to hold a volume figure of say, (that is (1–0.1) liters and the counter 31 is arranged to be clocked by pulses from the volume display 12 instead of the money display 13. When the counting means 31 indicates the final liter is being dispensed the comparator 34 compares the volume signals with the stored signals until 0.9 liter has been dispensed and the comparator signal operates the slow delivery valve for the remaining 0.1 liter.

The apparatus of both embodiments may also be used to control the dispensing of articles, each article delivered being counted and the delivery rate being slowed down for a final small number to ensure only the correct number are delivered.

It will be appreciated that the units of volume and currency used in this description are by way of example only and in use will depend upon the units of the country of use or the dispenser with which the apparatus is used.

What we claim is:

1. A circuit for controlling the dispensing of a preset amount of a product from apparatus having normal and low rates of delivery and metering means for measuring the quantity of product delivered and/or calculating the monetary value thereof, comprising switching means operable to produce different switch signals for individual preset amounts of material to be dispensed in multiples of a unit amount, counting means responsive to the detection of one of said switch signals to store the number of units represented by the switch signal and operable to change the number stored by one for each unit amount dispensed, storage means for storing the difference between a predetermined amount of product, less than a unit amount, and the unit amount, and comparison means responsive to an indication by the counting means that the final unit of the preset amount is being dispensed to compare continuously the amount of product dispensed in the final unit with the stored difference to provide a signal, when the amounts are equal, to cause the dispensing to be changed from a normal to a slow delivery rate for delivery of said predetermined amount.

2. A circuit as claimed in claim 1 in which the switching means comprises a clock, a counter having a triggering terminal and a plurality of output terminals and responsive to a signal applied to the triggering terminal to count clock pulses to energise in turn individual output terminals, a plurality of selector switches each associated with an individual output terminal and connected to the triggering terminal by way of gating means coupled to the output terminals such that operation of any selector switch causes the counter to count clock pulses until its associated output terminal is energised.

3. A circuit as claimed in claim 2 in which the the switching means includes a plurality of hexadecimal switches associated one with each output terminal of the counter and responsive to energisation of the associated output terminal to produce a binary coded signal, characteristic of the energised terminal, on a plurality of lines common to all of the hexadecimal switches.

4. A circuit as claimed in claim 3 in which the switching means includes a further selector switch operable to set the counter to energise a predetermined output terminal and a further hexadecimal switch responsive to energisation of the predetermined output terminal to produce a predetermined binary coded signal on said plurality of lines.

5. A circuit as claimed in claim 1 in which the counting means is arranged to receive the signal from the switching means to set a corresponding number into the counter and is responsive to triggering pulses representing the delivery of each unit amount to cause the number to decrease by one counter step and in which the counting means has a plurality of output terminals each associated with a particular number in the counter and gating means, to which all output terminals except those associated with the final two numbers of the count are connected, arranged to produce a signal when all terminals connected to the gating means are unenergised indicative of the count having reached the penultimate number.

6. A circuit as claimed in claim 1 in which the preset amount is the cost of a quantity dispensed and in which the storage means comprises a store counter having a number of locations corresponding to the number of cost increments in the unit value said store being initially set to a full state and arranged to count down by said cost increments for a predetermined quantity of product dispensed in any unit value.

7. A circuit as claimed in claim 6 including a further store arranged to receive cost increments by way of a rate multiplier to count down from a full state for said predetermined quantity of product dispensed such that the further stored value represents the difference between the cost of the unit value and a multiple of the cost of said predetermined quantity, and further comparison means responsive to an indication of the commencement of delivery of the final unit to compare cost increments for that unit with the further stored value to provide a signal when said multiple of the predetermined quantity remains.

* * * * *